US005746573A

United States Patent [19]

Junkin et al.

[11] Patent Number: 5,746,573

[45] Date of Patent: May 5, 1998

[54] VANE SEGMENT COMPLIANT SEAL ASSEMBLY

[75] Inventors: John Edward Junkin, Orlando; George Joseph Robinson, Oviedo, both of Fla.

[73] Assignee: Westinghouse Electric Corporation, Pittsburgh, Pa.

[21] Appl. No.: 775,823

[22] Filed: Dec. 31, 1996

[51] Int. Cl.[6] ..... F04D 29/38

[52] U.S. Cl. ..... 415/115

[58] Field of Search ..... 415/115, 116, 415/170.1; 416/95, 96 R

[56] References Cited

U.S. PATENT DOCUMENTS 4,113,406 9/1978 Lee et al. ..... 415/115

OTHER PUBLICATIONS

Scalzo, A.J. et al., "Evolution of Heavy-Duty Power Generation and Industrial Combustion Turbines in the United States", The Amerian Society of Mechanical Engineers, (Presented at the International Gas Turbine and Aeroengine Congress and Exposition), 1994, pp. 1–19.

*Primary Examiner*—John T. Kwon

[57] ABSTRACT

The present invention provides a vane segment compliant seal assembly. The assembly comprises a seal housing adapted to adjustably receive a baffle plate. The housing has an outer wall adapted to be in sealing communication with a vane segment rail and securely mounted within a combustion turbine. A baffle plate adapted to be in sealing communication with a vane segment rail is provided. The baffle plate is adjustably mounted within the housing to move from a first position to a second position relative to a vane rail. At least two compliant seals are provided which are adapted to be securely mounted between the seal housing outer wall and a vane segment rail, and between the baffle plate and a vane segment rail.

9 Claims, 3 Drawing Sheets

*FIG. 4*

VANE SEGMENT COMPLIANT SEAL ASSEMBLY

BACKGROUND OF THE INVENTION

1. Field of the Invention

This invention relates generally to combustion turbines and more particularly to combustion turbines having vane segment inner cavity seals.

2. Description of the Prior Art

Conventional combustion turbines comprise a compressor section, a combustion section, a turbine section, and turbine section airfoils, which include blades and vanes. Additionally, an annular flow path for directing a working fluid through the compressor section, combustion section, and turbine section is provided. The compressor section is provided to add enthalpy to the working fluid. Combustible fuel is added to the compressed working fluid in the combustion section and then combusted. The combustion of this mixture produces a hot, high velocity gas which is exhausted and directed by turbine vanes to impinge upon turbine blades within the turbine section. The turbine blades then rotate a shaft that is coupled to the compressor section to drive the compressor to compress more working fluid. Additionally, the turbine is used to power an external load.

The gas flow path of the combustion turbine is formed by a stationary cylinder and a rotor. The stationary vanes are attached to the cylinder in a circumferential array and extend inward into the hot, high velocity gas flow path. Similarly, the rotating blades are attached to the rotor in a circumferential array and extend outward into the hot, high velocity gas flow path. The stationary vanes and rotating blades are arranged in alternating rows so that a row of vanes and the immediately downstream row of blades form a stage. The vanes serve to direct the flow of hot, high velocity gas so that it enters the downstream row of blades at the correct angle. The blade airfoils extract energy from the hot, high velocity gas, thereby developing the power necessary to drive the rotor and the load attached to it.

The amount of energy extracted by each stage depends on the size and shape of the vane and blade airfoils, as well as the quantity of vanes and blades in the stage. Thus, the shapes of the airfoils are an extremely important factor in the thermodynamic performance of the turbine and determining the geometry of the airfoils is a vital portion of the turbine design.

As the hot, high velocity gas flows through the turbine, its pressure drops through each succeeding stage until the desired discharge pressure is achieved. Thus, the gas flow properties—that is, temperature, pressure, and velocity—vary from stage to stage as the hot, high velocity gas expands through the flow path. Consequently, each stage employs vanes and blades having an airfoil shape that is optimized for the gas flow conditions associated with that stage. It is noted that within a given row the airfoils are identical.

Since the turbine vane and blade airfoils are exposed to extremely high temperature gas discharging from the combustion section, it is of the utmost importance to provide a means for cooling the airfoils. Typically, combustor shell or compressor bleed air is used as the source of cooling the airfoils and other components proximate the airfoils. Additionally, the airfoils may have perforations which allow cooling air to flow to the outer surface of the airfoil thereby creating a cooling film. Specifically, some vane segments comprise an inside cavity that provides a cooling fluid flow path for cooling the vane segment.

Each vane segment comprises an outer shroud portion, an inner shroud portion and an airfoil therebetween. The inner shroud portion comprises an upstream seal rail and downstream seal rail. The outer shroud portion of each vane segment is mechanically coupled to the outer shell. The seal rails are mechanically coupled proximate the turbine inner shell with the interstage seal assembly therebetween to prevent a cooling fluid from leaking past the seal.

Conventional interstage seals comprise a spring loaded baffle plate and interstage seal housing. The upstream seal rail and baffle plate are placed in metal-to-metal contact, with the downstream seal rail and interstage seal housing placed in metal-to-metal contact to form the cooling fluid seal. This conventional interstage seal assembly, however, has several drawbacks.

One drawback with this type of assembly is that the baffle plate and seal housing are rigidly positioned in abutting relationship with the seal rails. These components are subject to distortion and/or displacement during normal turbine operation or during a refurbishment cycle. The displacement creates discontinuities or gaps between the sealing surfaces, and can lead to a relatively significant cooling fluid loss.

It is, therefore, desirable to provide a cooling fluid seal that compensates for distortion or displacement.

SUMMARY OF THE INVENTION

The present invention provides a vane segment compliant seal assembly. The assembly comprises a seal housing adapted to adjustably receive a baffle plate. The housing has an outer wall adapted to be in sealing communication with a vane segment rail and securely mounted within a combustion turbine. A baffle plate adapted to be in sealing communication with a vane segment rail is provided. The baffle plate is adjustably mounted within the housing to move from a first position to a second position relative to a vane rail. At least two compliant seals are provided which are adapted to be securely mounted between the seal housing outer wall and a vane segment rail, and between the baffle plate and a vane segment rail.

DETAILED DESCRIPTION OF THE PREFERRED EMBODIMENT(S)

Figure 1:
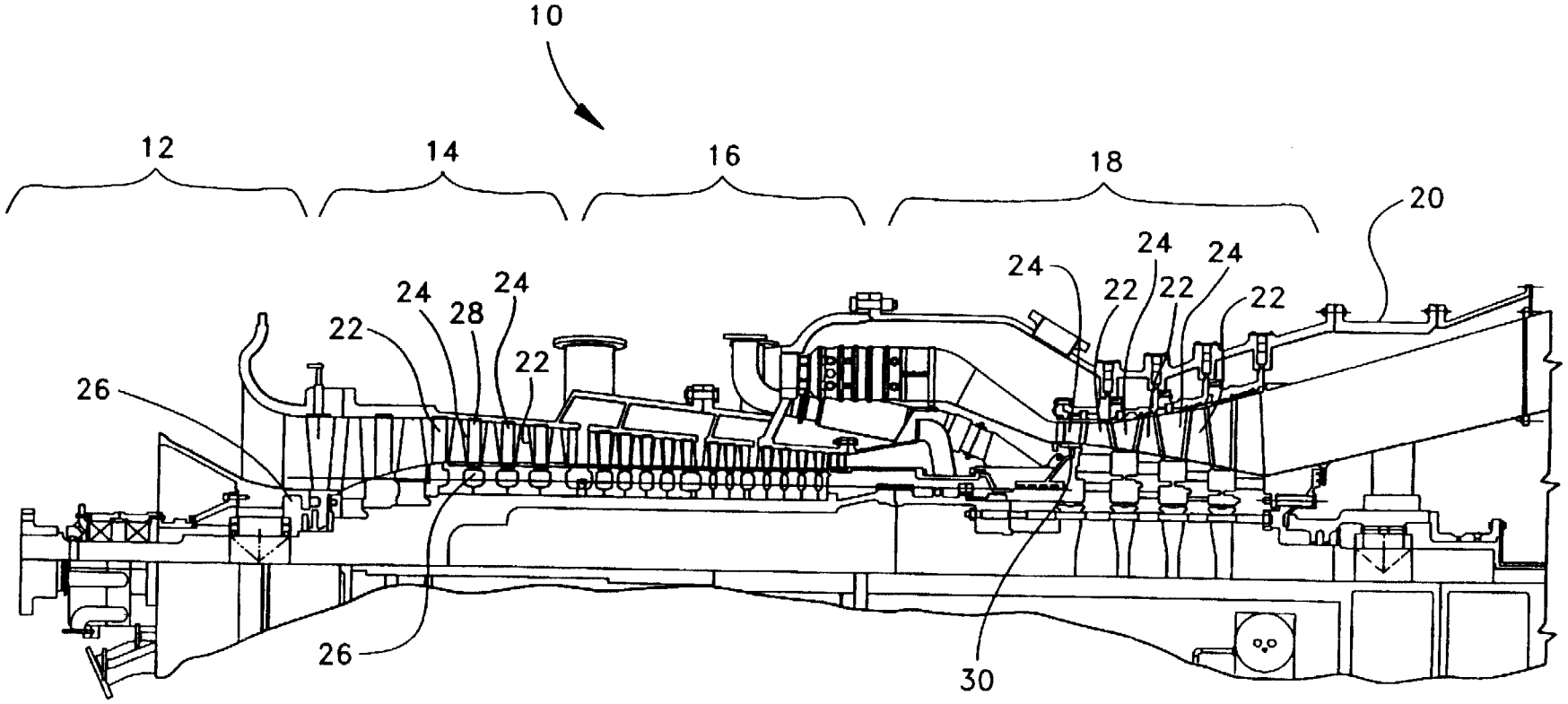
FIG. 1 is a partial cut-away view of a combustion turbine.

FIG. 1 shows a conventional combustion turbine 10. The combustion turbine 10 comprises an inlet section 12, a compressor section 14, a combustion section 16, and a turbine section 18 which are all generally enclosed by a casing 20.

The compressor section 14 and turbine section 18 are provided with alternating rows or stages of rotating blades 22 and stationary vane segments 24. The blades 22 are axially disposed about a rotor 26 and rotatably coupled to a shaft 28 that extends longitudinally through the combustion turbine 10.

The blades 22 in the compressor section rotate to compress air which is then directed by the stationary vane segments 24 to add momentum to the working fluid. Combustible fluid is added to the compressed working fluid in the combustion section 16 to produce a hot, high velocity gas. This hot, high velocity gas is exhausted through a nozzle and directed by the turbine vane segments 24 to impinge turbine blades 22 disposed along the shaft 28.

The stationary vane segments 24 and rotating blades 22 are arranged in alternating rows so that a row of vane segments 24 and the immediately downstream row of blades 22 form a stage. The vane segments 24 serve to direct the flow of hot, high velocity gas so that it enters the downstream row of blades 22 at the correct angle.

Figure 2:
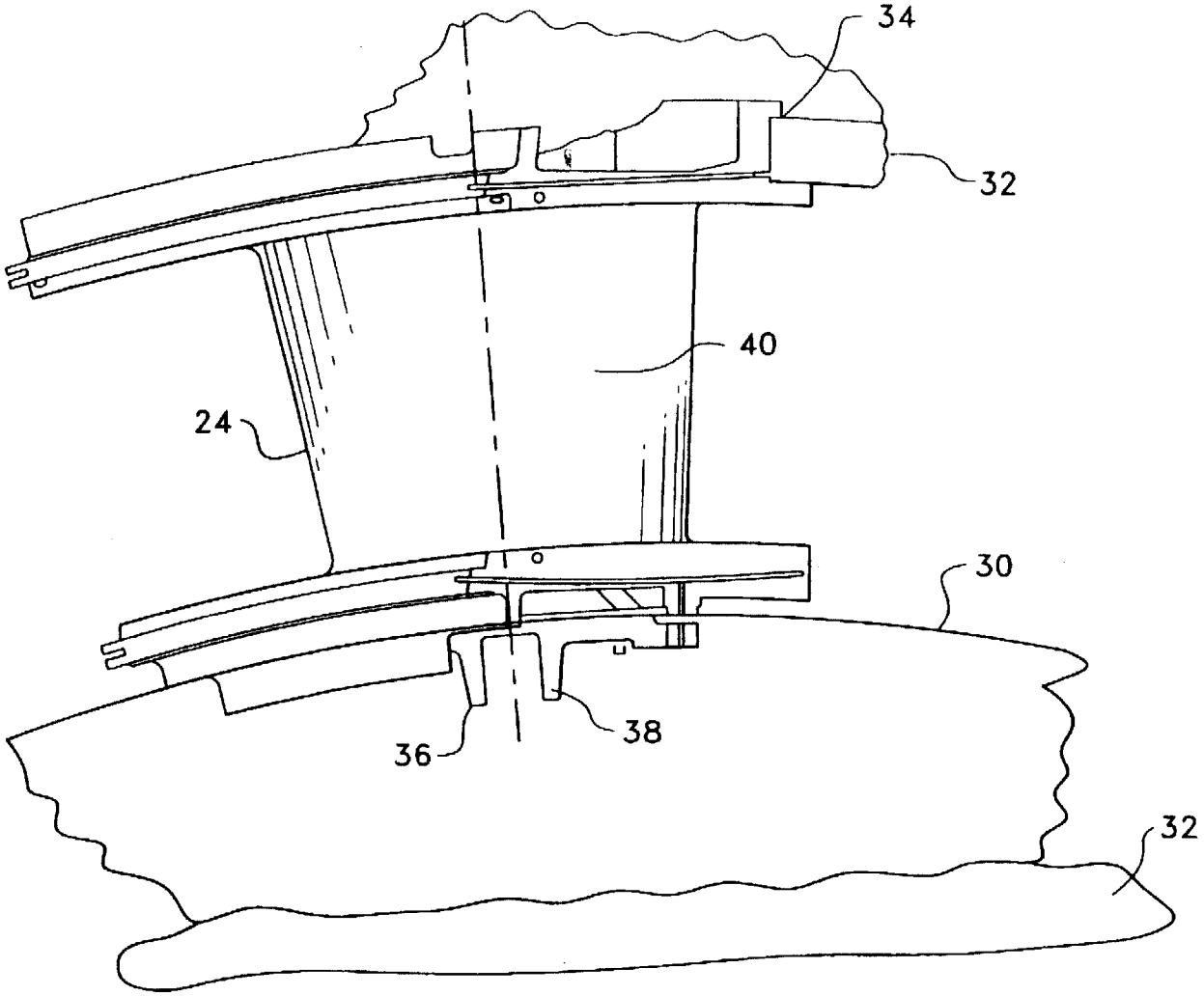
FIG. 2 illustrates one of a plurality of vane segments that are mounted in a combustion turbine.

FIG. 2 shows a single vane segment 24 supported and aligned circumferentially and radially with respect to the inner support ring 30 and outer cylinder 32 in the most desirable working position. The vane segment 24 comprises a fixed mounting portion 34 and vane segment rails 36 and 38 with an airfoil portion 40 therebetween. The vane segment 24 is mounted to the outer cylinder 32 along the vane segment fixed mounting portion 34, and adjustably supported at the inner support ring 30 proximate the vane segment rails 36 and 38. The inner support ring 30 is mechanically coupled to an inner cylinder (not shown).

Figure 3:
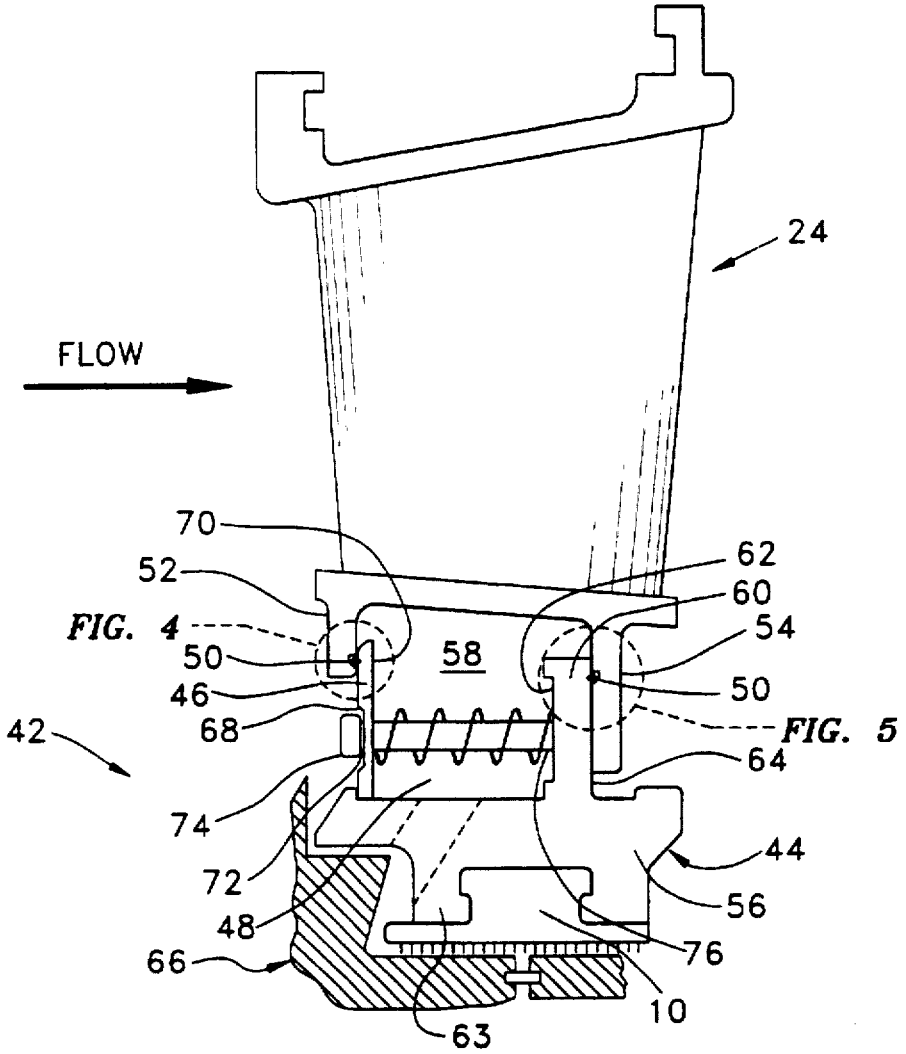
FIG. 3 shows a vane segment compliant seal assembly in accordance with the present invention.

FIG. 3 shows a vane segment compliant seal assembly 42 and vane segment 24 mounted in a combustion turbine for providing a cooling fluid seal in accordance with the present invention. The vane segment compliant seal assembly 42 comprises a interstage housing 44, baffle plate 46, coupling member 48 and a plurality of compliant seals 50. The vane segment compliant seal assembly 42 is coupled with the upstream rail 52 and downstream rail 54.

The interstage housing 44 comprises an outside wall 56 which defines a flow space 58, flange 60, and attaching end 62. The flow space 58 is adapted to be in fluid communication with the cooling fluid that is provided to cool the vane segment 24. The flange 60 has an inside surface 62 and outside surface 64. The flange 60 is adapted to securely receive the coupling member 48 proximate the flow space 58 and enable the baffle plate 46 to adjustably move along the coupling member 48 from a first position to a second position. The attaching end 62 is adapted to securely attach the interstage housing 44 within the combustion turbine 10 and is in fluid communication with a cooling fluid flow stream.

The baffle plate 46 is provided for containing and directing the cooling fluid from the vane segment 24 to cool the inner stage area 48 and the turbine disc 66. The baffle plate 46 has a relative upstream surface 68 and downstream surface 70. The upstream surface 68 and downstream surface 70 define a bore 72 that is adapted to adjustably receive the coupling member 48.

The coupling member 48 is adapted to adjustably mount with the baffle plate 46 and securely attach to the interstage housing 44. Preferably, the coupling member 48 is a spring loaded member having an upstream end 74 and downstream end 76. The upstream end 74 of the coupling member 48 is adapted to adjustably mount within the baffle plate bore 72. The baffle plate 46 and spring loaded coupling member 48 are coupled such that the baffle plate 46 spring biasingly engages the upstream seal rail 52. The coupling member downstream end 76 is adapted to securely attach to the inside surface 62 of the interstage housing flange 60. It is noted that other types of coupling members can be employed to enable the baffle plate 46 to adjustably move from a first position to a second position as is known in the art.

Preferably, the spring loaded coupling member 48 is adjustably coupled with the baffle plate 46, securely mounted with surface 62 of the interstage housing flange 60, and proximate the flow space 58 of the interstage housing 44. The baffle plate 46 is spring biasingly engaged with the upstream vane segment rail 52 with the compliant seal 50 therebetween. The outside surface 64 of the interstage housing flange 60 is in sealing engagement with the downstream vane segment rail 54 with the compliant seal 50 therebetween.

Figure 4:
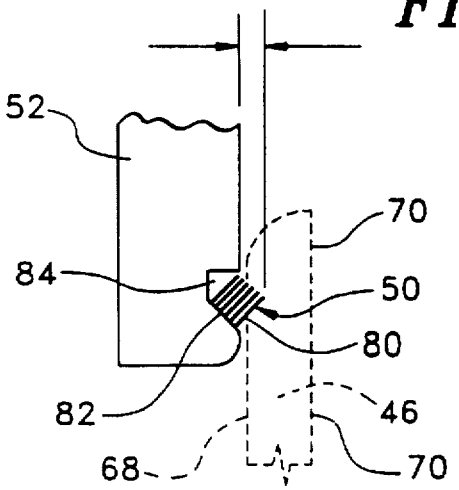
FIG. 4 shows a compliant seal in sealing communication with a spring loaded baffle plate and upstream vane segment rail.
Figure 5:
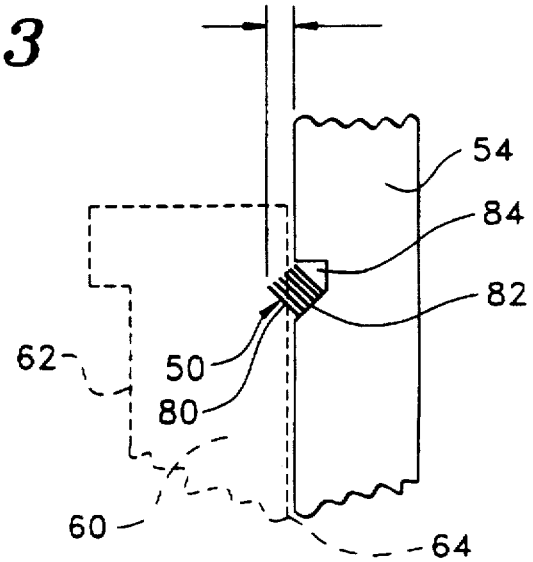
FIG. 5 shows a compliant seal in sealing communication with an interstage seal housing and downstream vane segment rail.

Referring to FIGS. 4 and 5, the compliant seals 50 are provided to substantially prevent leakage between the vane segment seal rails 52 and 54, baffle plate 46, and flange outside surface 64 before and after the vane segment is refurbished or repositioned. Preferably, the compliant seal 50 comprises a relatively densely packed bed of directionally compliant bristles 80 and a retainer bed 82. The bristles 80 are securely supported by the retainer bed 82. The bristles 80 can be made of "Haynes 25" material, manufactured by Haynes International, Inc., Kokomo, Ind. The retainer bed 82 can be made of "410 stainless steel or 2.25 cr steel" backing material.

The bristles 80 are adapted to conform to the space between the vane segment seal rails 52 and 54, baffle plate 46 and outside surface 64 of the interstage housing flange 60. The retainer bed 82 is adapted to securely mount with either the vane segment seal rails 52 and 54, baffle plate 46, and/or outside surface 64 of the interstage housing flange 60. The retainer bed 82 may be attached by attaching methods well known in the art. It is noted that the compliant seal 50 may take on other embodiments, for example, a compliant sleeve. The compliant sleeve is adapted to receive the seal rails 52 and 54, baffle plate 46, and/or interstage flange 60, or combinations thereof and provide the sealing function described herein.

Preferably, the vane segment seal rails 52 and 54 are formed with a notched area 84 adapted for securely receiving the compliant seals 50. Preferably, the retainer bed 82 is welded within each notched area 84 such that a sufficient seal is provided between the vane segment rails 52 and 54, baffle plate 46 and outside surface of the flange 60 when the vane segment is mounted in the combustion turbine. More preferably, the notched areas 84 are formed to securely receive the retainer bed 82 with the bristles 80 outwardly extending at an angle of approximately 30 degrees to about 75 degrees relative to each corresponding seal rail 52 and 54.

Although the seal rails 52 and 54 are shown adapted to securely receive the compliant seals 50 thereon, the baffle plate 46 and interstage housing 44 may be adapted to securely receive the compliant seals 50 and provide the same sealing function described herein.

The operation of the present invention will now be discussed. During start-up of the combustion turbine, the compressor is spun-up to ignition speed and as the compressor accelerates, compressed air from the compressor flow into the combustion turbine. A portion of the compressed air is bled off to bypass the combustion process and passes across the outer surfaces of the turbine section via pipe conduits and into a cooling flow channel (blade ring cavity) that is in fluid communication with the interstage housing 44 flow space 58. During the turbine operation, a portion of the cooling fluid has the tendency to pass proximate the upstream rail 52 and baffle plate 46, and downstream rail 54 and outside surface 64 of the interstage housing flange 60. In accordance with the present invention, however, the compliant seals 50 minimize fluid leakage at these areas. Also, in accordance with the present invention, the compliant seals 50 provide an adequate sealing arrangement when the vane segment 24, interstage housing 44, or other components proximate the interstage housing compliant seal assembly 42 are disoriented or refurbished.

It is to be understood that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

I claim:

1. A vane segment compliant seal assembly, said assembly comprising;

a seal housing adapted to adjustably receive a baffle plate, said housing having an outer wall adapted to be in sealing communication with a vane segment rail and securely mounted within a combustion turbine;

a baffle plate adapted to be in sealing communication with a vane segment rail, said baffle plate adjustably mounted within said housing to move from a first position to a second position relative to a vane rail; and at least two compliant seals, said compliant seals adapted to be securely mounted between said seal housing outer wall and a vane segment rail, and between said baffle plate and a vane segment rail.

2. The vane segment compliant seal assembly in claim 1, further comprising a vane segment having a relative upstream rail and a downstream rail, said upstream rail and downstream rail having a notched area, said at least two compliant seals securely mounted within said upstream rail notched area and said downstream rail notched area.

3. The vane segment compliant seal assembly in claim 1, wherein said plurality of compliant seals further comprises:

a retainer bed for securely receiving compliant bristles; and a plurality of compliant bristles securely attached to said retainer bed.

4. The vane segment compliant seal assembly in claim 1, wherein said plurality of compliant seals further comprise a compliant sleeve member.

5. The vane segment compliant seal assembly in claim 1, further comprising a coupling member for coupling said baffle plate with said seal housing, wherein said baffle member is adjustably coupled with said coupling member to move from a relative first position to a relative second position, and said coupling member securely attached to said seal housing.

6. The vane segment compliant seal assembly in claim 5, wherein said coupling member is a spring loaded coupling member.

7. A combustion turbine comprising:

a compressor for compressing air;

a combustor for producing a hot gas by combusting a fuel and air mixture;

a turbine with a vane segment, said vane segment having an upstream vane segment rail and downstream vane segment rail; and a vane segment compliant seal assembly, said assembly sealing coupled with said upstream seal rail and downstream seal rail, wherein said vane segment compliant seal assembly further comprises:

a seal housing adapted to adjustably receive a baffle plate;

a baffle plate adjustably mounted with said housing and adapted to move from a first position to a second position relative to said upstream seal rail; and a plurality of compliant seals, said plurality of compliant seals securely mounted between said seal housing outer wall and vane segment rail, and between said baffle plate and vane segment rail.

8. The combustion turbine in claim 7, wherein said plurality of compliant seals further comprise:

a retainer bed for securely receiving compliant bristles; and a plurality of compliant bristles securely attached to said retainer bed.

9. The combustion turbine in claim 7, wherein said plurality of compliant seals further comprises a compliant sleeve member.

* * * * *